United States Patent [19]

Ritten

[11] Patent Number: 4,719,989

[45] Date of Patent: Jan. 19, 1988

[54] BOAT BOARDING LADDERS HAVING A STOWAGE FEATURE

[75] Inventor: Robert G. Ritten, Ft. Pierce, Fla.

[73] Assignee: Step-On Inc., Ft. Pierce, Fla.

[21] Appl. No.: 66,527

[22] Filed: Jun. 26, 1987

[51] Int. Cl.[4] ..... B63B 29/20; E06C 7/48; E06C 1/36

[52] U.S. Cl. ..... 182/93; 182/206; 114/362

[58] Field of Search ..... 182/206, 214, 93, 178; 114/362

[56] References Cited

U.S. PATENT DOCUMENTS

| | | | |
|---|---|---|---|
| 2,758,770 | 8/1956 | Wagner | 182/206 |
| 2,843,393 | 7/1958 | Dahlander | 182/206 |
| 3,078,955 | 2/1963 | Rich | 182/206 |
| 3,774,720 | 11/1973 | Hovey | 182/97 |
| 3,804,200 | 4/1974 | Sandberg | 182/206 |
| 3,858,683 | 1/1975 | Rachocki | 182/156 |
| 3,944,024 | 3/1976 | Adaz | 182/206 |
| 4,002,223 | 1/1977 | Bernkrant | 182/206 |
| 4,462,485 | 7/1984 | Terry | 182/84 |
| 4,637,492 | 1/1987 | Herr | 182/93 |

*Primary Examiner*—Reinaldo P. Machado
*Attorney, Agent, or Firm*—Carroll F. Palmer

[57] ABSTRACT

Improved boat boarding ladders, that may be mounted on a boat in a boarding position wherein they extend into the water and mounted in different stowage position wherein they are clear of the water, are formed of a step section, a support section and mounting units, all of which are separable from each other. The step section has a pair of tubular siderails and a plurality of steps fixed between them. The support section includes a pair of U-shaped tubular members each braced by a bar that is fixed at its ends across the arcuate portion of such member. One free end of each U-shaped member is enlarged so the upper end of a siderail may be fitted therein and locked with a through pin so the support section extends normal to the step section. The mounting units each include a tubular portion into which ends of the U-shaped support section members may be fitted to hold the ladder in the boarding position, while ends of the step section siderails may be so fitted to mount the ladder in the stowage position. During stowage, the U-shaped members are folded to align with the ladder steps.

8 Claims, 9 Drawing Figures

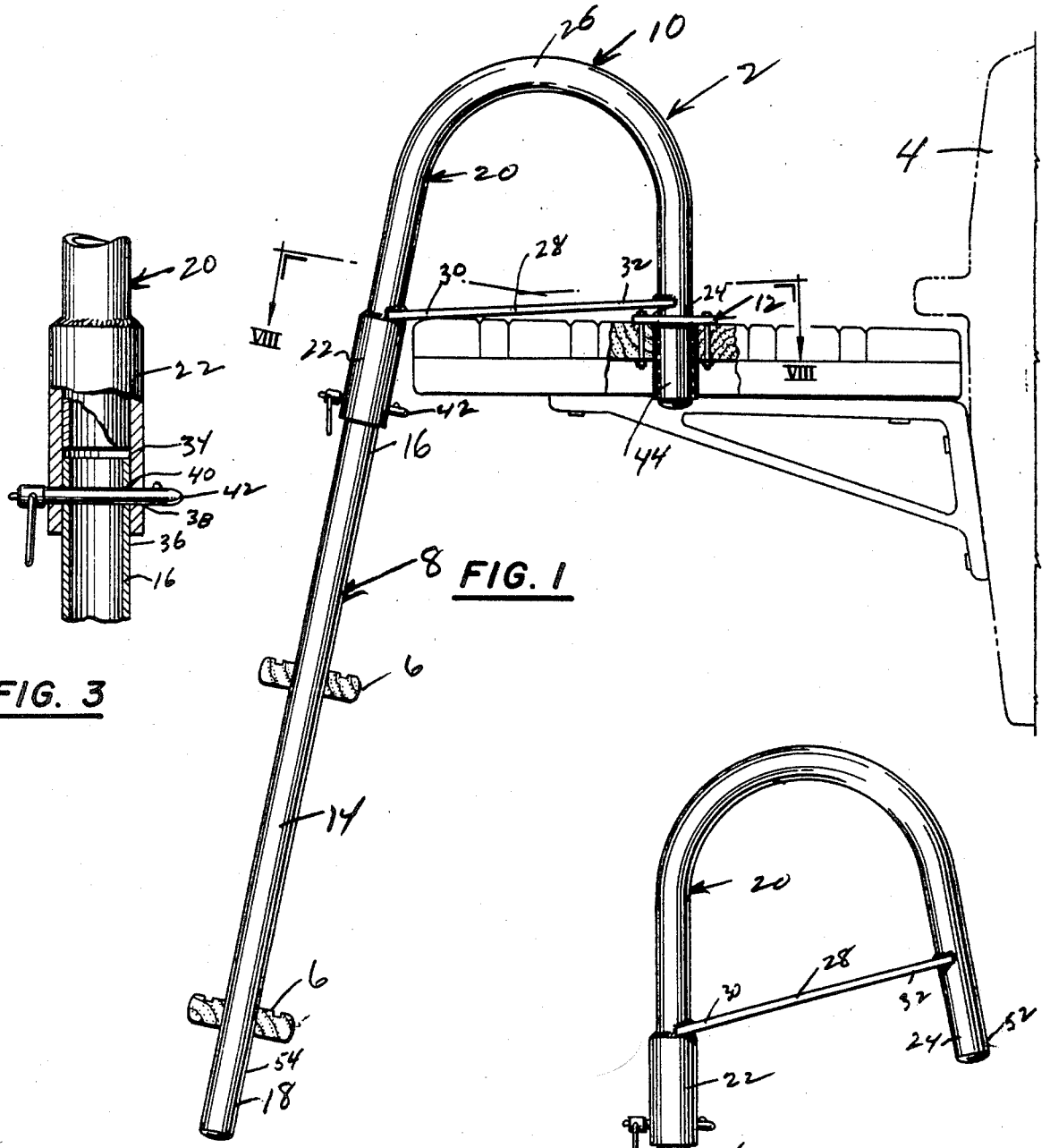
FIG. 1
FIG. 3
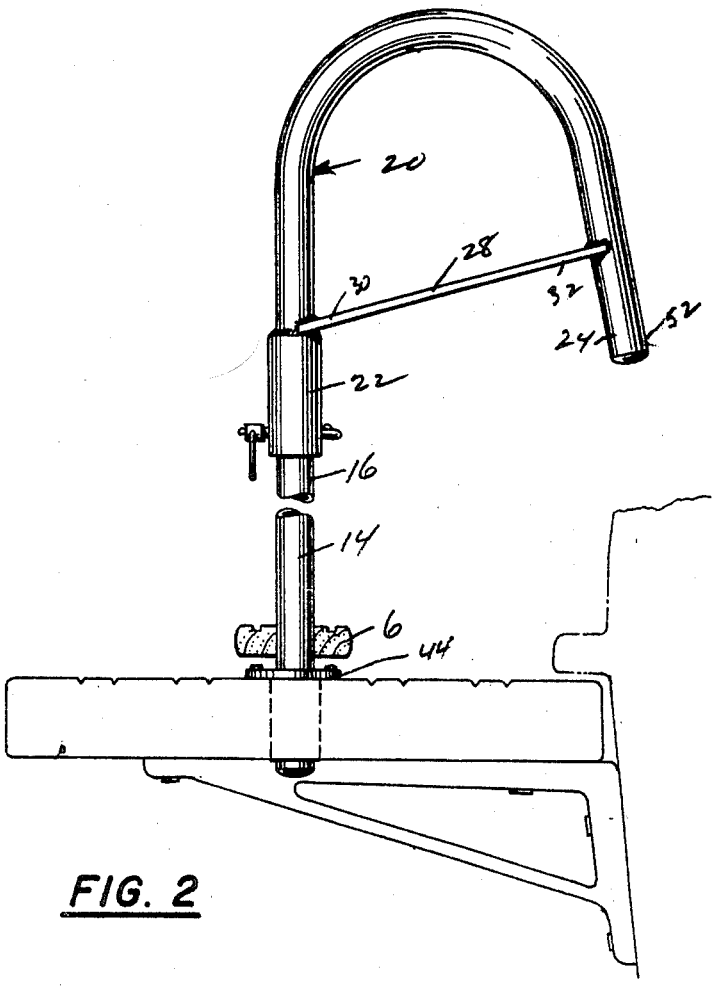
FIG. 2

BOAT BOARDING LADDERS HAVING A STOWAGE FEATURE

BACKGROUND OF THE INVENTION

1. Field of the Invention

This invention relates to boarding ladders for boats. More particularly, it concerns such ladders designed primarily to be mounted on pleasure boats, particularly pontoon and raft type boats, either in a lowered, boarding position in which at least part thereof is immersed in the water or a raised, stowage position clear of the water with parts thereof folded into a space saving arrangement.

2. Description of the Prior Art

Boarding ladders for pleasure boats, as opposed to those intended for use on freighters and other large vessels, can be divided into two broad classes, namely, those that are carried on mounts permanently attached to the boat and those that simply hang by a hook portion on the boat during use. This invention relates to the type that involve permanent attachment mounts.

Some ladders of the permanent mount type are attached to platforms that extend from the boat, generally aft of the stern, e.g., see U.S. Pat. No. 4,462,485 and co-pending U.S. patent application Ser. No. 901,268, filed Aug. 29, 1986. Others of the permanent mount type are designed to be attached directly to the topsides per se of the boat, e.g., see U.S. Pat. No. 3,774,720 and co-pending U.S. patent application Ser. No. 917,801, filed Oct. 10, 1986 and U.S. patent application Ser. No. 048,543, filed May 11, 1987. This invention relates to boat ladders that can be mounted in both ways, i.e., on a stern platform or directly on the boat topsides.

One problem with boat boarding ladders on a variety of pleasure boats is their storage when not in use. Pontoon boats and raft boats which have become very popular for use on inland waterways are examples of the type of pleasure boats on which this storage problem has been acute. This invention provides improved boarding ladders that can be conveniently stowed on pontoon and other boats in a safe, space saving manner when not in use.

OBJECTS

A principal object of the invention is the provision of boat boarding ladders with improved stowage capabilities.

Further objects include the provision of:

1. Boat boarding ladders particularly suitable for use on pontoon, raft or like boats.

2. Boat boarding ladders capable of being mounted both on stern platforms and gunwales.

3. Such ladders that can be stowed in assembled condition in mount units permanently attached to a portion of the boat or in dissembled condition in a storage locker, lazarette, etc.

4. Such ladders that can be fabricated simply from metal tubing and bars, except for optional wooden treads.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects are accomplished in accordance with the invention by the provision of improved boat boarding ladders that may be mounted on a boat in a boarding position wherein at least part thereof extends into the water surrounding the boat and mounted in a different stowage position wherein they are clear of such water.

Such new boat ladders comprise a step section, a support section and mount means.

The step section comprises a pair of tubular spaced apart siderails, each having upper ends and lower ends. A plurality of steps are fixed between the siderails so the upper ends of the siderails extend above the uppermost of the steps and the lower ends extend below the lowermost of the steps.

The support section comprises a pair of U-shaped tubular members each defined by a first free end, a second free end and an integral arcuate portion joining the free ends together. Each U-shaped member includes a bar that is fixed, such as by welding, at one of its ends to the arcuate portion near the first free end and at its other end to the second free end.

The first free end of each U-shaped member has an inside perimeter that is approximately equal to the outside perimeter of the tubular siderails whereby the upper ends of the siderails may be fitted into the first free ends of the U-shaped members.

There are a first pair of opposed holes in each of the first free ends and a second pair of opposed holes in each of the upper ends of the side rails to mate with the first pair permitting a removable pin to be inserted through the first and second pairs to hold the step section depending from the support section.

The mount means includes a pair of mount units each having a tubular portion and a plate portion fixed to the tubular portion normal thereto. The tubular portion of each of the mount units has an inside perimeter that is approximately equal to the outside perimeter of the second free ends of the U-shaped members whereby such second free ends may be fitted into the mount unit tubular portions. Also, the outside perimeter of the tubular siderails is substantially identical to the outside perimeter of the second free ends whereby the ladder may be stowed in the stowage position by inserting the lower ends of the siderails into the tubular portions of the mount units In preferred embodiments, the steps include flat treads and the siderails and other tubular portions of the ladders have a circular cross-section so the aforesaid perimeters are diameters. Further, the plate portions of the mount units include openings therein through which fasteners may extend and the steps comprise metal bars welded to the siderails and have flat tread members affixed thereto.

BRIEF DESCRIPTION OF THE DRAWINGS

A more complete understanding of the invention may be had by reference to the accompanying drawings in which:

FIG. 1 is a lateral, partially fragmented view of a boat ladder of the invention installed on the stern platform of a boat and mounted in its boarding position.

FIG. 2 is a lateral view of the ladder of FIG. 1 mounted in a stowage position.

FIG. 3 is an enlarged, partial sectional view of the portion of the ladder that connects its step section to its support section.

DESCRIPTION OF THE PREFERRED EMBODIMENTS

Figure 6:
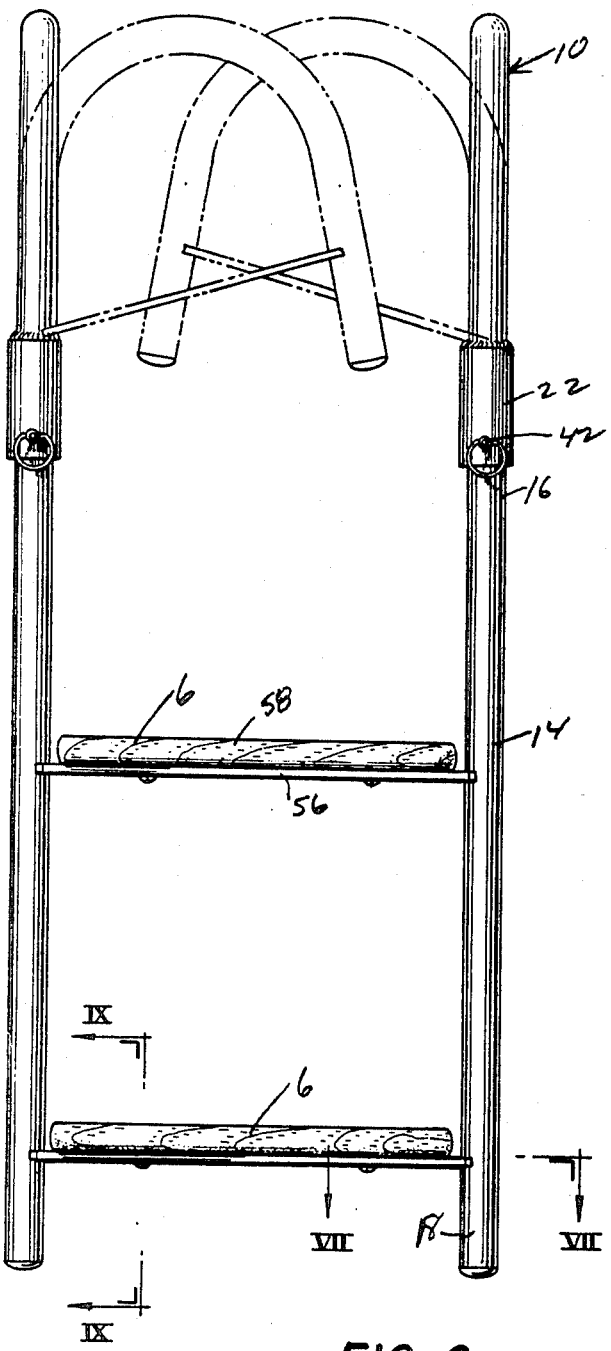
FIG. 6 is a plan view of a ladder of the invention.
Figure 4:
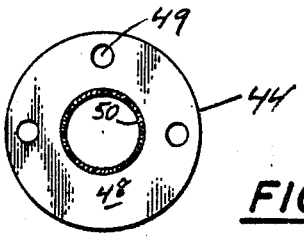
FIG. 4 is a plan view of a mount unit for the ladders of the invention.
Figure 5:
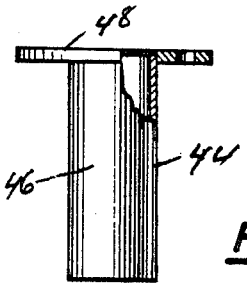
FIG. 5 is a lateral, partially sectionalized view of the mount unit of FIG. 4.
Figure 7:
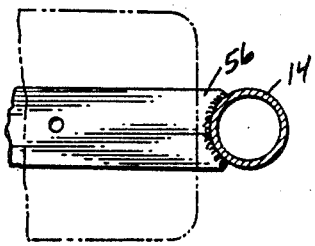
FIG. 7 is a sectional view taken on the line VII—VII of FIG. 6.
Figure 9:
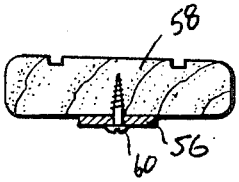
FIG. 9 is a sectional view taken on the line IX—IX of FIG. 6.
Figure 8:
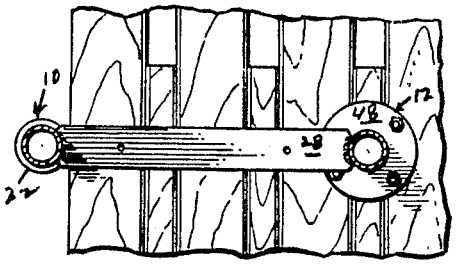
FIG. 8 is a sectional view taken on the line VIII—VIII of FIG. 1.

Referring in detail to the drawings, in which identical parts are identically marked, the invention concerns improved boat boarding ladders 2 that may be mounted on a boat 4 in a boarding position, as seen in FIG. 1, wherein at least one step 6 thereof extends into the water surrounding the boat (not shown) and mounted in a stowage position, as seen in FIG. 2, wherein it is clear of the water.

The ladder 2 comprises a step section 8, a support section 10 and mount means 12.

The step section 8 comprises a pair of tubular, spaced apart siderails 14 having upper ends 16 and lower ends 18 with a plurality of steps 6 fixed therebetween. The upper ends 16 of the siderails 14 extend above the uppermost of the steps 6 and the lower ends 18 extend below the lowermost of the steps.

The support section 10 comprises a pair of U-shaped tubular members 20 each defined by a first free end 22, a second free end 24 and an integral arcuate portion 26 joining the free ends together. Each U-shaped member 20 includes a bar 28 that is fixed at one of its ends 30 to the arcuate portion 26 near the first free end 22 and at its other end 32 to the second free end 24.

The first free end 22 of the U-shaped member has an inside perimeter 34 that is approximately equal to the outside perimeter 36 of the tubular siderails 14 whereby the upper ends 16 of the siderails 14 may be fitted into the first free ends 22 of the U-shaped members 20. As an alternate embodiment within the scope of the invention (not shown), the upper ends of the siderails could be enlarged to receive the free end of the U-shaped member having a perimeter of the same size as the remainder thereof.

There is first pair of opposed holes 38 in each of the first free ends 22 and a second pair of opposed holes 40 in each of the upper ends 16 of the side rails 14 to mate with the first pair 38 permitting a removable pin 42 to be inserted through the first and second pairs to hold the step section 8 depending from the support section 10.

The mount means 12 includes a pair of mount units 44 each having a tubular portion 46 and a plate portion 48 fixed normal to the tubular portion 46. The plate portion 48 includes openings 49 therein through which fasteners may extend.

The tubular portion 46 of each of the mount units 44 has an inside perimeter 50 that is approximately equal to the outside perimeter 52 of the second free ends 24 of the U-shaped members 20 whereby they may be fitted into the mount unit tubular portions 46. Also, the outside perimeter 54 of the tubular siderails 14 is substantially identical to the outside perimeter 52 of the second free ends 24 whereby the ladder may be stowed in the stowage position seen in FIG. 2 by inserting the lower ends 18 of the siderails 14 into the tubular portions 46 of the mount units 44.

In the boarding position, the U-shaped members 20 of the support section 10 are fixed by the pins 42 normal to the steps 6, while in the stowage position members 20 may be aligned with the steps, as shown by phantom lines in FIG. 6, to reduce the space required for stowage either by inserting the siderail ends 18 into mount units 44 or being placed in a locker (not shown) or like storage space. Additionally, a second pair of mount units 44 may be provided on some other portion of the boat 4 (not shown) so that the ladder 2 can be stowed in an upright position back away from the gunwale. This type of installation is particularly useful with pontoon and raft type boats where a convenient place for the ladder to be used in the boarding position is at the bow of the boat, but this is not a suitable location for the ladder when in the stowage position.

In preferred ladders 2 of the invention, the steps 6 comprise a metal bar 56 welded to the siderails with flat tread members 58 affixed thereto such as by screws 60. In other embodiments, metal tubes welded to the siderails may serve per se as steps or as supports for flat treads made of wood, plastic, etc.

In the embodiment of the improved boarding ladder 2 shown in the drawings, all tubular elements in the ladder have a circular cross-section, but they can have cross-sections of other shape, e.g., square, rectangular, etc. Stainless steel is the preferred material form which to form the tubular elements, but other metals, e.g., aluminum, or materials resistant to corrosion by seawater may be used.

The embodiments of the invention in which an exclusive property or privilege is claimed are defined as follows:

1. An improved boat boarding ladder that may be mounted on a boat in a boarding position wherein at least one step thereof extends into the water surrounding said boat and mounted in another stowage position wherein it is clear of such water which comprises:

a step section, a support section and mount means, said step section comprising a pair of tubular spaced apart siderails having upper ends and lower ends and a plurality of steps fixed between said siderails, said upper ends of said siderails extending above the uppermost of said steps and said lower ends extending below the lowermost of said steps, said support section comprising a pair of U-shaped tubular members each defined by a first free end, a second free end and an integral arcuate portion joining said free ends together, each said U-shaped member including a bar that is fixed at one of its ends to said arcuate portion near said first free end and at its other end to said second free end, said first free end of said U-shaped member having an inside perimeter that is approximately equal to the outside perimeter of said tubular siderails whereby said upper ends of said siderails may be fitted into said first free ends of said U-shaped members, a first pair of opposed holes in each of said first free ends and a second pair of opposed holes in each of said upper ends of said side rails to mate with said first pair permitting a removable pin to be inserted through said first and second pairs to hold said step section depending from said support section, and said mount means including a pair of mount units each having a tubular portion and a plate portion fixed to said tubular portion normal thereto, said tubular portion of each of said mount units having an inside perimeter that is approximately equal to the outside perimeter of said second free ends of said U-shaped members whereby said second free ends may be fitted into said mount unit tubular portions.

2. The improved boarding ladder of claim 1 wherein said steps include flat treads.

3. The improved boarding ladder of claim 1 wherein said outside perimeter of said tubular siderails is substantially identical to said outside perimeter of said second free ends whereby said ladder may be stowed in said stowage position by inserting said lower ends of said siderails into said tubular portions of said mount units.

4. The improved boarding ladder of claim 1 wherein said tubular siderails have a circular cross-section.

5. The improved boarding ladder of claim 1 all tubular elements in said ladder have a circular cross-section.

6. The improved boarding ladder of claim 1 wherein said plate portion includes openings therein through which fasteners may extend.

7. The improved boarding ladder of claim 1 wherein said steps comprise metal bars welded to said siderails with flat tread members affixed thereto.

8. An improved boat boarding ladder that may be mounted on a boat in a boarding position wherein at least one step thereof extends into the water surrounding said boat and mounted in another stowage position wherein it is clear of such water which comprises:

a step section, a support section and mount means, said step section comprising a pair of tubular spaced apart siderails of circular cross-section each having an upper end and a lower end with a plurality of steps fixed therebetween, said upper ends of said siderails extending above the uppermost of said steps and said lower ends extending below the lowermost of said steps, said support section comprising a pair of U-shaped tubular members of circular cross-section each defined by a first free end, a second free end and an integral arcuate portion joining said free ends together, each said U-shaped member including a bar that is fixed at one of its ends to said arcuate portion near said first free end and at its other end to said second free end, said first free end of said U-shaped member having an inside diameter that is approximately equal to the outside diameter of said tubular siderails whereby said upper ends of said siderails may be fitted into said first free ends of said U-shaped members, a first pair of opposed holes in each of said first free ends and a second pair of opposed holes in each of said upper ends of said side rails to mate with said first pair permitting a removable pin to be inserted through said first and second pairs to hold said step section depending from said support section, said mount means including a pair of mount units each having a tubular portion of circular cross-section and a plate portion fixed to said tubular portion normal thereto, said tubular portion of each of said mount units having an inside diameter that is approximately equal to the outside diameter of said second free ends of said U-shaped members whereby said second free ends may be fitted into said mount unit tubular portions, and a third pair of opposed holes in either each of said first free ends or in each of said upper ends permitting a removable pin to be inserted through said third pair holes to lock said U-shaped tubular members in a stowage position substantially aligned with said steps.

* * * * *